United States Patent [19]

Bela et al.

[11] 4,290,285

[45] Sep. 22, 1981

[54] CYLINDRICAL LOCK WITH A MAGNETIC BODY

[75] Inventors: Romvari Bela, Pomaz; Kakonyi Gyula, Budapest, both of Hungary

[73] Assignee: Elzett Müvek, Budapest, Hungary

[21] Appl. No.: 967,592

[22] Filed: Dec. 8, 1978

[30] Foreign Application Priority Data

Dec. 17, 1977 [HU] Hungary ..... 2538

[51] Int. Cl.[3] ..... E05B 47/00

[52] U.S. Cl. ..... 70/276; 70/365; 70/417

[58] Field of Search ..... 70/276, 358, 366, 417, 70/365

[56] References Cited

U.S. PATENT DOCUMENTS

| | | | |
|---|---|---|---|
| 1,422,497 | 7/1922 | Thompson | 70/417 |
| 3,665,740 | 5/1972 | Taniyama | 70/276 |
| 3,855,827 | 12/1974 | Hallman | 70/134 |
| 3,935,720 | 2/1976 | Boving | 70/276 |

FOREIGN PATENT DOCUMENTS

| | | | |
|---|---|---|---|
| 2514920 | 10/1976 | Fed. Rep. of Germany | 70/417 |

*Primary Examiner*—Robert L. Wolfe

[57] ABSTRACT

A cylinder lock has a lock body with a cylindrical throughbore and two longitudinally extending grooves in its internal surface. A lock cylinder is mounted in the throughbore for rotation therein between a locking position and an unlocking position and has a longitudinally extending key passage and is responsive to the insertion of a suitable magnetic key in the key passage to enable rotation thereby from a locking to an unlocking position. A plurality of magnetic bodies are mounted on both sides of the key passage for rotation about an axis perpendicular to the longitudinal axis of the cylinder to a unique angular position when the suitable key is inserted with corresponding recesses which are longitudinally aligned in two lines when the magnetic bodies are in their unique position. Two blocking laths are slidably mounted on either side of the key passage alignable with and receivable in the grooves when the lock cylinder is in the locking position to enable movement into a blocking position therein and alignable with and receivable in the recesses when the magnetic bodies are in their unique positions and are urged outwardly from the lock cylinder into the blocking position.

9 Claims, 4 Drawing Figures

CYLINDRICAL LOCK WITH A MAGNETIC BODY

Figure 1:
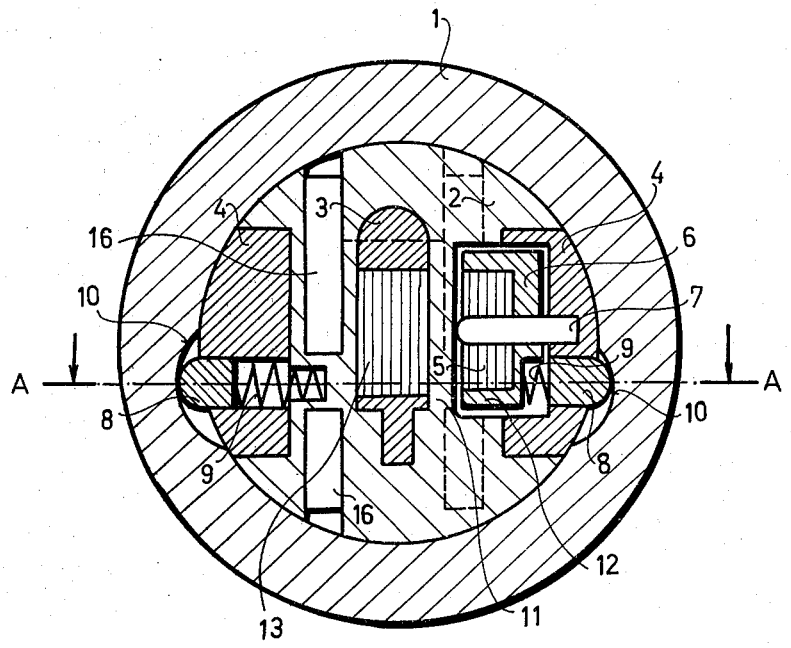

The invention relates to a cylindrical lock to be operated by means of magnetic bodies, which can be manufactured as interchangeable units and built-in as insets into building-locks, latch locks, furniture-locks or any locking devices.

Insets for cylindrical locks operated by means of toothed or graduated keys and blocked by spring-loaded pins have been known and widely used for a long time; in the last years several examples have been mentioned in technical literature and a tendency could be observed to apply said locks of different versions on the single fields of application, f.i. as locking devices actuated by means of locking elements controlled by magnetic keys to be used in car-locks. At these solutions in one of the members of the locking mechanism, generally in the bores or in the machined cavities of the cylindrical body movable magnetic elements to be controlled by magnetic keys are arranged in such a manner that in general the magnetic members performing blocking can be pushed into the lock-body and pulled out, respectively, when the cylindrical pins are actuated by the magnet of the key in the direction of attraction or repulsion, whereby the rotation of the cylindrical body—together with the bit turning or pushing the lock-blade—becomes possible.

The drawback of the locking devices to be actuated by moving in a straight direction due to the magnetic attraction of repulsion lies in, that they can be easily unlocked, since by changing the poles of the key magnet performed in a certain order of sequence or by displacing the magnetic device pushed into the key-hole, the positions of the magnetic locking members activating the blocking pins can be successively sensed.

The disadvantages enumerated above have drawn the attention to the solutions aiming the development of magnetic cylindrical locks, at which magnetic bodies arranged in a turnable manner are applied, by the rotation of which actuation of the blocking elements preventing the rotation of the cylindrical body becomes possible, partly in their open position permitting rotation, partly in the opposite direction, when locking takes place.

Solutions based on said functional principle are described in the specification of the German Pat. DT-OS Nos. 2 353 047 and 2413 555, at which the magnetic bodies are arranged lengthwise in bodies of rotation in the cylindrical body and the magnets in the body of rotation are turned in such a position by the permanent magnets arranged in the shaft of the key pushed into the key-channel, that the locking body preventing the rotation of the cylindrical body could be moved from its blocking position in the housing of the lock-body into its unlocking position.

The disadvantages and defects of the cylindrical locks described in said German specifications do not make the application in practice possible.

Inter alia the oblique surfaces of the locking bodies penetrating into the housing of the lock body are unable to ensure definite blocking, since the locking bodies can be released from their blocking position against their unstable spring supports, by the frequent power effects evoked radially on their oblique surfaces by tilting the cylindrical body. There are no protective means, which could prevent the forced rotation or intervention resulting in destruction; the locking bodies can be tilted and under the influence of a stress the pins of the locking bodies are easily sheared. The springs supporting the locking bodies are not fixed in their position either.

Unlocking of said lock-mechanisms will be enabled by the radial or tilting movement tending towards the cylindrical body, while said movements become possible by receding the pins into the aperture of the casings of the magnetic bodies. When this process can be prevented, forced rotation of the cylindrical body can be inhibited and blocking of the cylindrical body in its locking position is achieved.

However, the function of the locking bodies resulting from the tilting movements or force is unsure, thus even when inserting the proper key, blocking may occur.

The defects and disadvantages cited as examples in connection with the locking devices described in the German specifications, are to be considered as general and characteristic, because these are to be found at all cylindrical locking structures operating with magnets. A further disadvantage lies in that the key-channel is closed, as a consequence any alien object or contamination getting into the channel by accident or on purpose, may cause troubles, since due to the closed state of the key-channels cleaning can be performed in a disassembled state only.

The disadvantages described explain the fact, that neither the solution cited, nor any other solutions based on cylindrical locks to be controlled by magnetic keys and magnetic elements, mainly known from patents, have been proposed for production; they did not prove to be suitable for general use, accordingly neither serial production, nor wide-spread use became possible.

The aim of our invention has been to develop a locking device and inset, respectively, being suitable for activating magnetic bodies and being free of the drawbacks enumerated, which can be properly used without any functional trouble, simultaneously enabling serial and mass production at low production costs, while the multipurpose units can be equally used as building- and furniture locks, to vehicle and latch locks.

The novelty of the invention lies in that on the opposite sides of the turnable internal cylinder of the lock-inset, preferably in rotor-house-like bodies, which can be arranged as insets in the cavities specially formed for this purpose, there are blocking laths for the so-called blocking of the rotation and release i.e. unlocking of the inner cylinder, respectively, arranged, in which there are the rotors comprising the magnetically controlled bodies being suitable for the adjustment into unlocked and blocked i.e. functional and working positions. The rotors provided with magnetic bodies are turned into the suitable position by means of a magnetic key known in itself.

In the wall of the outer casing forming the lock-body and receiving the inner cylinder in a turnable manner there are the groove-like recesses to be found, receiving lengthwise the blocking laths, which serve for preventing the rotation of the inner cylinder. Said recesses are shaped in an arched manner; after having released the blocked position, and when the inner cylinder begins to turn, the arched surfaces of the blocking grooves in the lock-body are pushing out the blocking-laths supported by the springs from their blocking position. In the rotor houses there are the cavities, which are guiding and receiving the laths pushed out from their blocking position, while on the rotors incorporating the magnetic bodies, steps are formed, supporting the blocking laths in their released position.

In the longitudinal direction of said laths, for the secure support of the blocking laths in their unlocked or blocking position, a rotor provided with at least two steps has been applied. After having turned the inner cylinder into the locking position, the blocking laths are pushed back by the force of the supporting springs into the grooves within the lock-body i.e. into their locking position.

In order to increase protection of the cylindrical locks against extraneous intervention and wilful destruction, structural solutions have been provided for, f.i. the shaft of the magnetic key is formed with a graded profile, i.e. with stiffening ribs arranged lengthwise, whereas the key-channel is also formed with a hollow profile; the key-channel is furthermore provided with steel insets, preferably pins, preventing the penetration of destructive means, besides multilateral protection during use is increased by a safety mechanism with a ball-catch.

Figure 1A:
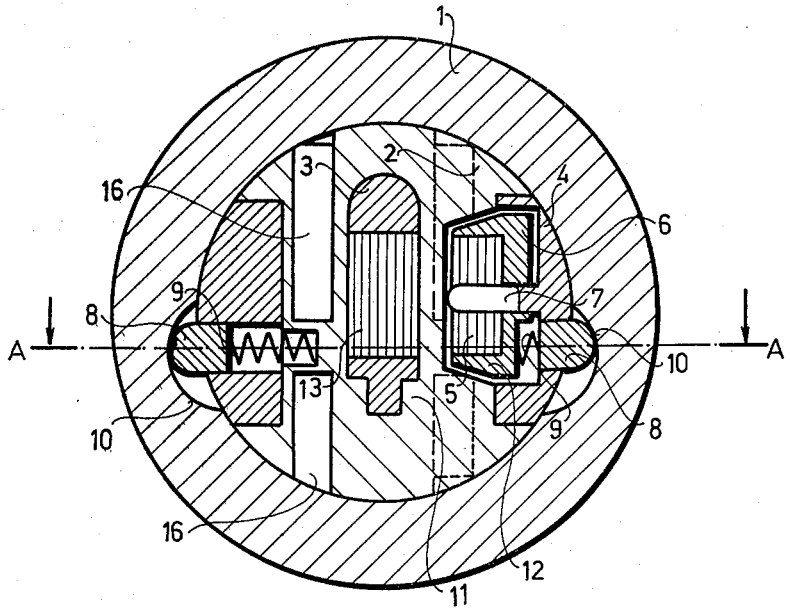
Figure 2:
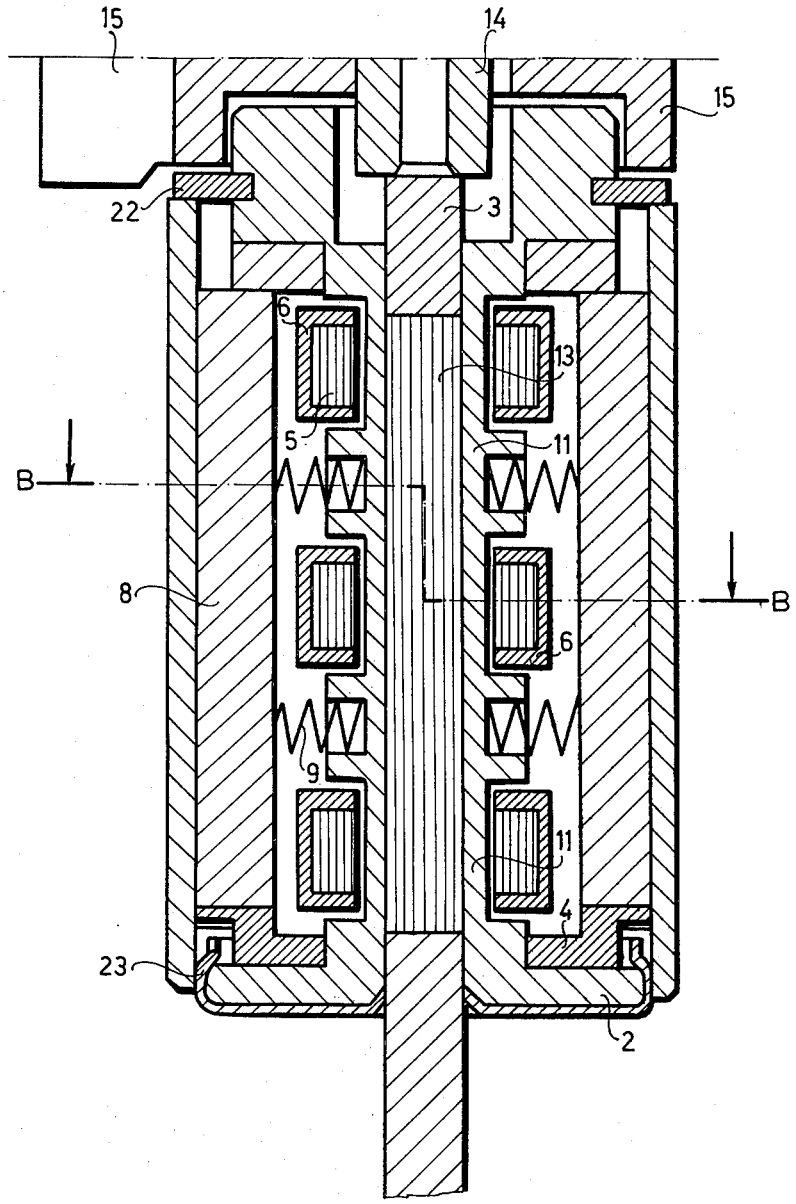
Figure 3:
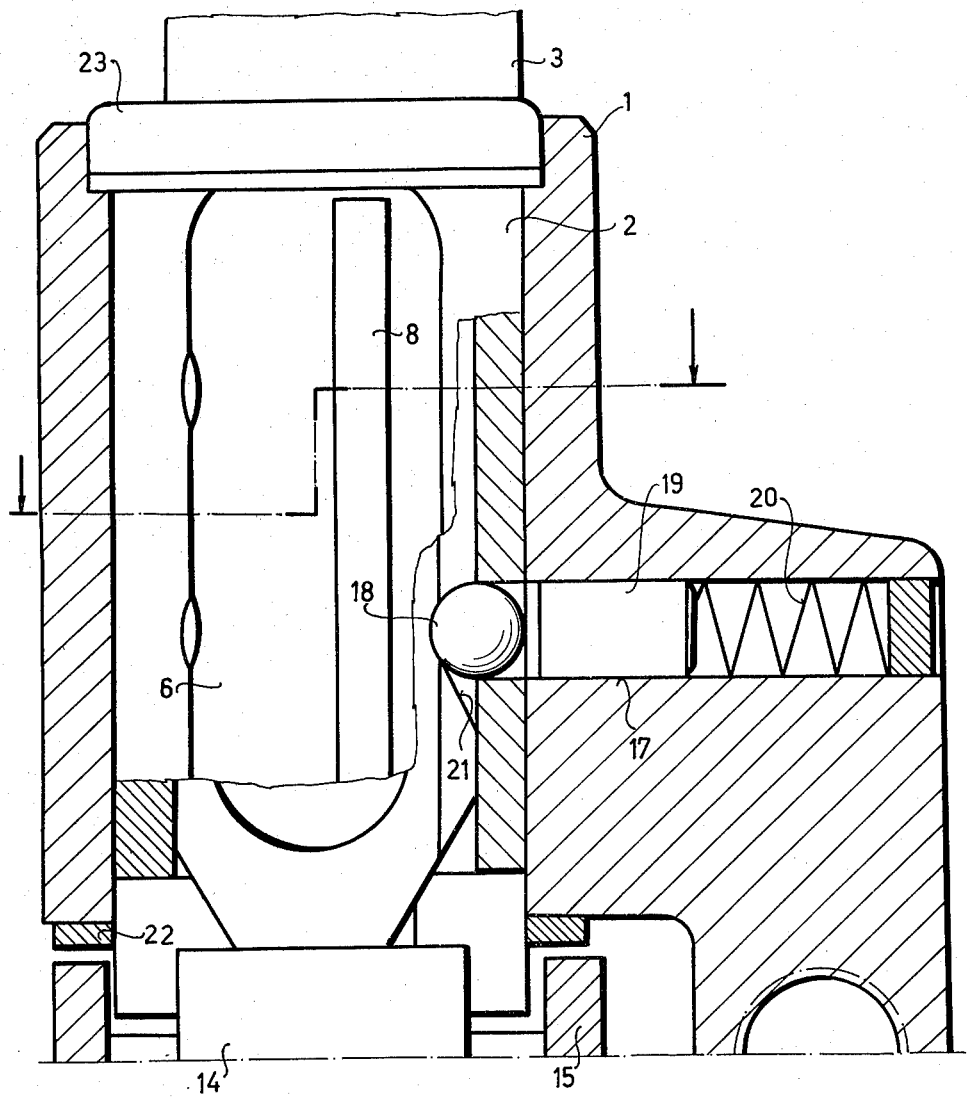

The invention will be described by means of a preferable embodiment, by the aid of the drawings enclosed, where FIG. 1 is showing the magnetically operated lock-inset to be used to building doors, FIG. 1*a* illustrates a version of the embodiment according to FIG. 1, in a section through B—B of FIG. 2, FIG. 2 is showing the longitudinal section, taken along the plane A—A of the lock-inset being in its locked state, FIG. 3 is showing the magnetic lock-inset built-in into the lock-body, illustrated in a fractional section taken in the vertical symmetry plane.

The inner cylinder 2 embedded into the lock-body 1 forming the outer cylinder of the cylindrical lock, shaped as a unit, which can be built-in a known manner, can be turned by means of the proper key 3. On both sides of the inner cylinder, in the symmetrically formed cavities thereof, the rotor-houses 4 are arranged, which can be rotated—together with the inner cylinder 2—in the lock-body/FIGS. 1 and 2/.

In the seat-like recess of the rotor-house 4 the rotors 6 comprising the magnetic bodies 5 are pivoted around the pivot 7. Preferably, the pivots 7 are made of high-tensile materials, but they can be made of the material of the rotors or the rotor-houses too.

In the lock-mechanism according to the invention, on each side there is one rotor-house 4 each provided with the rotors 6 incorporating three magnetic bodies each, arranged, accordingly, a locking mechanism—doubling the known magnetic lock-devices, operated by a duplicated blocking, at which the bilateral wedging of the blocking laths 8 prohibits turning-off of the internal cylinder by means of an extraneous object—is available.

The embodiment illustrated in FIG. 1*a* is showing a developed construction, operational safety has been increased, simultaneously forced external intervention becomes impossible; due to the conical shape of the mantle-surface, surfacial bearing is better, the magnetic bodies 5 are protected with a higher efficiency, furthermore an increased supporting surface, being more resistant to attempted turning and power effects can be achieved. The pivots 7 facilitate easy rotation of the rotors; the pivots can be made of the material of the rotor houses, since the conical surfaces of the rotor bodies are also taking part in the centralization of the rotation. The pivots 7 of the rotors are displaced in relation of the centreline of the inner cylinder 2, resulting partly in a more definite blocking, partly enabling the increase of the thickness of the partition walls 11 confining the key-channel, by the stepped formation of the shaft of the key 3. The step-profiled shape of the lower part of the key 3 renders the insertion of an alien key more difficult, furthermore on both sides of the partition walls increased by said stepping, pins made of hardsteel, so-called dam-pins 16, preventing counterboring of the inner cylinder 2, may be arranged.

Taking out/pulling out/ the proper key 3 from the key-channel becomes possible in an unlocked or locked state of the lock only, i.e. in a 0° -position of the key. Taking out is ensured by a ballcatch-mechanism.

On the mantle of the rotor-houses 4 the blocking laths 8 are lengthwise arranged and the are kept in their entire length in a pushed-in state in the blocking grooves 10 machined in the wall of the lock-body 1, by means of the springs 9. With their opposite ends the springs 9 are bearing up against the partition walls 11 confining the channel of the key 3, and are led in the bores of the rotor-houses 4, accordingly they are unable to leave their range of action.

The blocking grooves 10 are arched, thus, when the inner cylinder has been rotated, they are pushing the blocking laths 8 against the force of the springs 9 into the rotor-houses 4. The blocking laths are kept in their pushed-in position by means of the steps 12 of the rotors 6. Control of the rotors 6 and thus turning-off the inner cylinder 2 is performed by means of the magnetic inset/s/ 13 enclosed in the proper key 3 and by the magnetic insets of suitable polarity arranged in the rotors 6. Actuation of the magnetic lock-inset takes place—starting from the position seen on the right side of FIG. 1—as follows:

By inserting the proper key 3, the magnetic inset 13 of the same adjusts the rotor 6 with the permanent magnets, with the steps 12 into the direction complying to that of the blocking laths 8, whereby the steps of the rotors ensure the necessary supporting surfaces for the blocking laths penetrating into the rotor-house, as a consequence, rotation of the inner cylinder 2 may take place. When rotation takes place, the blocking grooves 10 are pushing both blocking laths 8 into the rotor-houses 4 beside the steps 12 of the rotors 6 and turn by means of the cluth plate 14—connected to the inner cylinder 2 in a known manner—the carrier 15 of the slide, actuating the latch/FIG. 2/.

Above the hole 17 bored into the rib connecting the halves of the lock-body 1 /FIG. 3/, in the wall between the key-channel and the inner cylinder 2 there is a cavity for receiving the ball 18. The ball 18 is kept in its cavity and pressed into the seat 21 machined into the shaft of the key 3 by means of the pin 19 arranged in the closed hole 17 and by means of the spring 20.

Snapping of the ball 18 simultaneously defines the grade of rotation and the position of the key, when taking out of the key is intended. The ball snapping mechanism in itself, but also the pin 19—when intruding—prevent the forced rotation of the inner cylinder 2 to an extent increased by the shearing stress of the material. The channel of the key 3 is open at the end, thus any contamination getting in can be removed without difficulty.

Arrangement of the inner cylinder 2 in the lock-body 1, the turnable fixation by means of the ring 22 and covering with the ornamental-plate 23 can be performed in the usual manner.

The magnetic inset to cylindrical locks may be used to new and already existent building-locks, it can be manufactured in interchangeable sizes for the use to other locking mechanisms. The magnetic inset for locks can be manufactured for one-or two-leafed doors, to be used one-or two-sided.

The inner cylinder 2 of the lock-mechanism can be made of a zinc-alloy by using hot-chamber die casting technology or of copper alloy by cutting; other parts of the components, the rotor 6, the rotor-house 4, can be made of zinc-alloy. The house and the lock-body, respectively, may be manufactured of two kinds of materials, it can be shaped in a traditional manner or in a material-saving form, as illustrated in FIG. 3. The cylindrical form of the end of the parts of the lock-body 1 is of utmost importance, and its advantage lies in that in the plane of the door there is no surface accessible for an external grip.

Besides the light weight the great advantage of the house shaped in a material-saving form lies in, that due to the lack of gripping possibilities, turning-off in a destructive manner—representing the greatest danger among forced unlocking methods—becomes impossible.

The rotor and the keymagnets are highly dense permanent magnets of low permeability. The magnetic field in a coded arrangement can be generated by means of the high-capacity inpulse generator, as a consequence, coercive force of the magnet bodies is much higher, than that of the usual ones, accordingly, demagnetization does not occur. Magnetic aging is insignificant and does not influence safety of blocking.

Cylindrical magnetic locks of smaller sizes, f.i. for furnitures, may be produced with two magnetic rotors each on the single sides. The number of the basic variations at a lock-inset of magnetic system—in case of two rotors each with two magnetic field on each side—amounts to 2 985 384. This number of locking variations exceeds many times the number of locking variation of the customary lock-insets and reduces possibility of superpositions.

On each side the number of rotors for each inset should be at least two, but it can be even more; more, than two rotor-series can also be used.

On basis of the high number of locking variations, blocking units with keys in different quantities, i.e. different keys/main-key, master-key etc./ can be manufactured.

The possibilities of realization and advantages are not restricted to the embodiment described here. The invention can be realized in such a manner that the cavities of the magnetically controlled rotors are formed in the inner cylinder body, leaving-off the the rotor-houses. From the point of view of reduced productional and assembly costs, it is of utmost importance, that the units of the blocking mechanism/rotors, rotor-houses, blocking laths/are symmetrically formed.

What we claim:

1. A cylinder lock comprising: a lock body having a cylindrical throughbore and two longitudinally extending grooves in the internal surface of the throughbore; and a lock cylinder mounted in the throughbore for rotation therein between a locking position and an unlocking position and comprising a longitudinally extending key passage and magnetically actuatable means coactive with the grooves to prevent rotation from the locking to the unlocking position and responsive to the insertion of a suitable magnetic key in the key passage to enable rotation thereby from the locking to the unlocking position including a plurality of magnetic bodies, means mounting the magnetic bodies on both sides of the key passage for rotation about an axis perpendicular to the longitudinal axis of the cylinder to a unique angular position when the suitable key is inserted wherein, the mounting means have recesses therein which are longitudinally aligned in two lines when the magnetic bodies are in their unique position, two blocking laths slidably mounted on either side of the key passage alignable with and receivable in the grooves when the lock cylinder is in the locking position to enable movement into a blocking position therein and alignable with and receivable in the recesses when the magnetic bodies are in their unique positions to enable movement into an unblocking position therein and means urging the blocking laths outwardly from the lock cylinder into the blocking position.

2. The lock as claimed in claim 1, further comprising radially extending dam pins in the lock cylinder walls surrounding the key passage.

3. The lock as claimed in claim 1, wherein the axes of rotation of the magnetic bodies are off center in relation to the axis of rotation of the lock cylinder.

4. The lock as claimed in claim 1, wherein the means mounting the magnetic bodies comprises rotors formed with one of a conical and cylindrical mantle surface.

5. The lock as claimed in claim 1, wherein the suitable key has a stepped profile at a predetermined longitudinal position and means coactive with the stepped profile to prevent removal of the key when the cylinder is in other than the locking position.

6. The lock as claimed in claim 5, wherein the means coactive with the stepped profile comprises a ball-snap mechanism.

7. The lock as claimed in claim 1, wherein the grooves have an arched profile.

8. The lock as claimed in claim 4, comprising a series of at least two rotors on each side of the key passage.

9. The lock as claimed in claim 1, wherein the key passage extends entirely through the lock cylinder.

* * * * *